US011587706B2

(12) United States Patent
de la Rosa

(10) Patent No.: US 11,587,706 B2
(45) Date of Patent: Feb. 21, 2023

(54) MAGNETIC FASTENER

(71) Applicant: Christopher J. de la Rosa, Montclair, NJ (US)

(72) Inventor: Christopher J. de la Rosa, Montclair, NJ (US)

( * ) Notice: Subject to any disclaimer, the term of this patent is extended or adjusted under 35 U.S.C. 154(b) by 0 days.

(21) Appl. No.: 16/672,328

(22) Filed: Nov. 1, 2019

(65) Prior Publication Data

US 2021/0134501 A1 May 6, 2021

(51) Int. Cl.
*H01F 7/02* (2006.01)
*E05C 19/16* (2006.01)

(52) U.S. Cl.
CPC ..... *H01F 7/02* (2013.01); *E05C 19/16* (2013.01); *A44D 2203/00* (2013.01); *E05Y 2900/20* (2013.01)

(58) Field of Classification Search
CPC ..... H01F 7/02
See application file for complete search history.

(56) References Cited

U.S. PATENT DOCUMENTS 2,717,437 A 9/1955 Mestral
3,009,235 A 11/1961 Mestral
3,111,737 A 11/1963 Heil
4,455,719 A * 6/1984 Morita ..... E05C 19/16 24/303
4,941,235 A * 7/1990 Aoki ..... A45C 13/1069 24/303
5,050,276 A * 9/1991 Pemberton ..... A44C 5/2076 24/616
5,367,891 A * 11/1994 Furuyama ..... A44C 5/2057 63/3
5,572,773 A * 11/1996 Bauer ..... A41F 1/002 24/303
5,933,926 A 8/1999 Reiter
6,170,131 B1 * 1/2001 Shin ..... A41F 1/002 24/303
7,523,527 B2 * 4/2009 Garber ..... A44C 5/2061 24/303
7,817,002 B2 * 10/2010 Fullerton ..... A45F 5/02 335/306

(Continued)

OTHER PUBLICATIONS https://en.wikipedia.org/wiki/Halbach_array, Wikipedia the free encyclopedia, Oct. 28, 2019.

(Continued)

*Primary Examiner* — Jason W San

(57) ABSTRACT

A novel magnetic fastener is realized that utilizes a pair of multipole magnets rotatable relative to each other, allowing the holding force to be selected for ease of operation, namely closing and opening. Each multipole magnet includes a striped pattern of alternating polarity (north and south poles), with the striped patterns having the same pole spacing or pitch. When the stripes of alternating north and south poles are oriented lengthwise, the stripes of the south poles can judiciously align with the stripes of the north poles from the other magnet, creating a strong magnetic force between them to form a fastener. However, when the striped pattern of alternating north and south poles are oriented substantially orthogonal, the stripes are mutually being alternating attracted and repelled, allowing the magnets to be easily separated to effect opening.

8 Claims, 6 Drawing Sheets

(56) References Cited

U.S. PATENT DOCUMENTS

| | | | | |
|---|---|---|---|---|
| 7,839,247 | B2 * | 11/2010 | Fullerton | H01F 7/0284 335/306 |
| 7,843,295 | B2 * | 11/2010 | Fullerton | G09F 7/04 335/306 |
| 7,843,296 | B2 * | 11/2010 | Fullerton | G09F 7/04 335/306 |
| 8,035,260 | B2 * | 10/2011 | Fullerton | G09F 7/04 310/49.01 |
| 8,384,346 | B2 * | 2/2013 | Fullerton | H02K 21/22 320/108 |
| 8,752,252 | B2 * | 6/2014 | Ninomiya | H01F 7/0263 24/303 |
| 8,794,682 | B2 * | 8/2014 | Fiedler | E05B 15/04 292/251.5 |
| 10,342,299 | B2 * | 7/2019 | Reiter | A44B 17/0088 |
| 2009/0083951 | A1 * | 4/2009 | Maurer | H01F 7/0278 24/303 |
| 2012/0284969 | A1 * | 11/2012 | Fullerton | H01F 13/003 24/303 |
| 2015/0305432 | A1 * | 10/2015 | Wiens | A43B 1/0054 36/97 |
| 2016/0003269 | A1 * | 1/2016 | Russell-Clarke | A45F 5/00 24/303 |
| 2017/0234340 | A1 * | 8/2017 | Pensak | A41F 1/002 24/3.1 |

OTHER PUBLICATIONS https://www.kjmagnetics.com/blog.asp?p=halbach-arrays, KJ Magnetics, Oct. 28, 2019.

* cited by examiner

MAGNETIC FASTENER

FIELD OF THE INVENTION

The present invention is directed to a magnetic fastener suitable for use in various consumer and industrial applications.

BACKGROUND OF THE INVENTION

Various devices have been used for fastening a wide variety of materials, such as fabric, leather, plastic and wood. For example, magnetic snap fasteners used for fabric and leather employ male and female sections that are magnetically coupled, usually with a solid projection adapted to fit within a hole of a circular magnet. Various configurations have been designed to enhance opening and closing of the fastener. See, for example, U.S. Pat. Nos. 3,111,737; 5,933,926; and 6,170,131, which are incorporated herein by reference.

Although magnetic fasteners are well suited for fabric and leather, it is also common to use Velcro® fasteners that consist of two strips of velvet material. Typically, one strip has many nylon hooks, and the other strip has thinner loops that the hooks can cling to when the two strips are pressed together. A force of considerable magnitude is required to separate the two strips. It is well known that it is much easier to peel rather than to pull them apart. See U.S. Pat. Nos. 2,717,537 and 3,009,235, which are also incorporated herein by reference.

For doors and cabinets constructed of plastic and wood, magnetic latches are preferred. A strong magnet is recessed into a steel circular or rectangular enclosure that is attached to a surface, and a corresponding strike metal plate attached to the other surface. In close proximity, the strike plate is attracted to the magnet to effect secure closure with a holding force of several pounds. Flush mounting can be effected by counterboring a hole in one or more of the surfaces, if desired.

While magnetic and Velcro® fasteners have become ubiquitous, and perform satisfactorily, it would still be desirable to have an alternative fastening device having potentially greater applications.

SUMMARY OF INVENTION

A novel magnetic fastener is realized that utilizes a pair of multipole magnets, rotatable relative to each other, allowing the holding force to be selected for ease of operation, namely closing and opening. Each multipole magnet includes a striped pattern of alternating north and south poles having about the same pole spacing or pitch. When the striped patterns of alternating polarity are oriented lengthwise, the stripes of the south poles can judiciously align with the stripes of the north poles from the other magnet, and vice-a-versa, creating a strong magnetic force between them to form a fastener. However, when the striped patterns of alternating north and south poles are oriented substantially orthogonal, the stripes are mutually being alternating attracted and repelled, allowing the magnets to be easily separated to effect opening.

Each multipole magnet may employ a Halbach array, wherein the alternating polarity has a spatially rotating pattern such that the magnetic field on one side is strong, and weak on the opposing side. The multipole magnets are placed on two materials configured to magnetically couple to each other when brought into close proximity. The multipole magnets are oriented so that the "strong side" face toward each other so as to shield any possible external electronics. The magnets are each disposed within respective recessed regions of the housings to prevent them from displacing laterally or vertically, but one, however, is free to rotate, allowing the holding force to be selected for closing and opening. The multipole magnets may be made from ferromagnetic material such as Neodymium, and disk in shape, each with a central hole through which a tubular pin allows the magnet to rotate. Applying a torque on a handle connected to the tubular pin rotates the multipole magnet so as to position the fastener in either its "latch" or "unlatch" position. A marker positioned on the handle may be used to indicate the "latch" and "unlatch" configurations. The multipole magnets can be fabricated from a flexible Neodymium magnet sheet having stripes of alternating polarity (north and south poles).

Alternatively, one of the multipole magnets may be disposed within a recessed region of a cap housing that is attached to either side of the material. Grooves or indents can be fabricated around the periphery of the cap housing to make it easier to rotate.

BRIEF DESCRIPTION OF THE DRAWINGS

The features and advantages of the present invention will become more readily apparent from the detailed description of the invention in which like elements are labeled similarly, and in which.

DETAILED DESCRIPTION

Figure 1A:
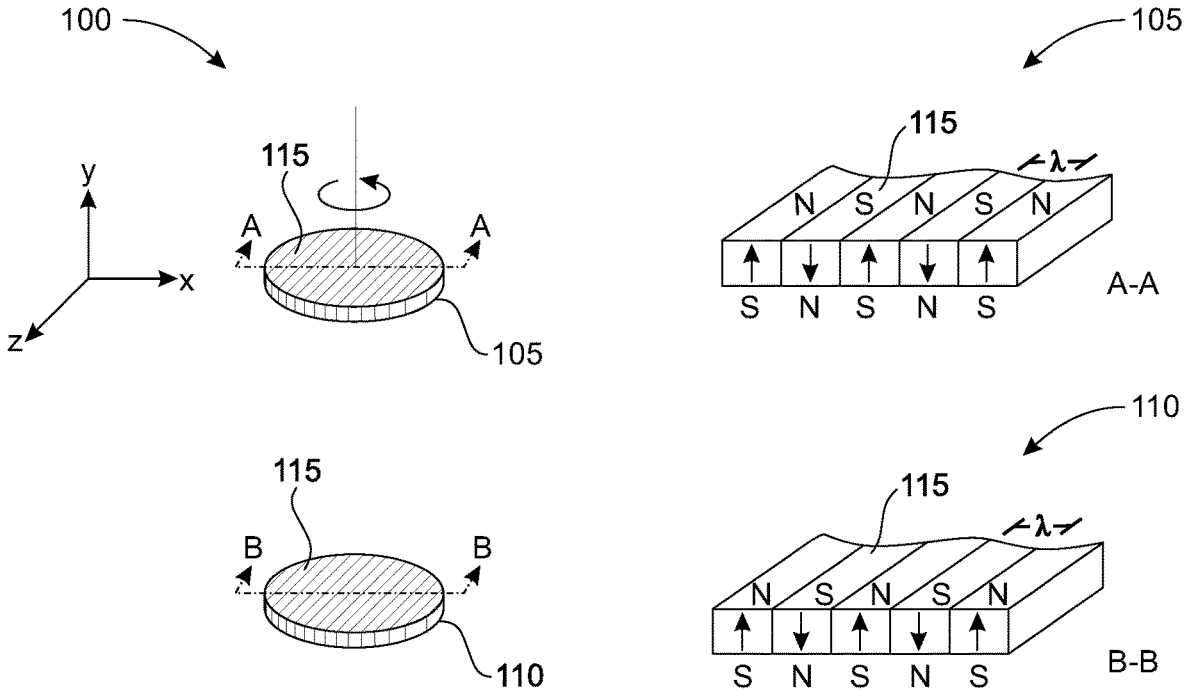
FIG. 1A and FIG. 1B are perspective views of magnets utilized in the present invention having alongside thereof a cross-section of the alternating polarity of north and south poles, for the latch and unlatch states, respectively.
Figure 1B:
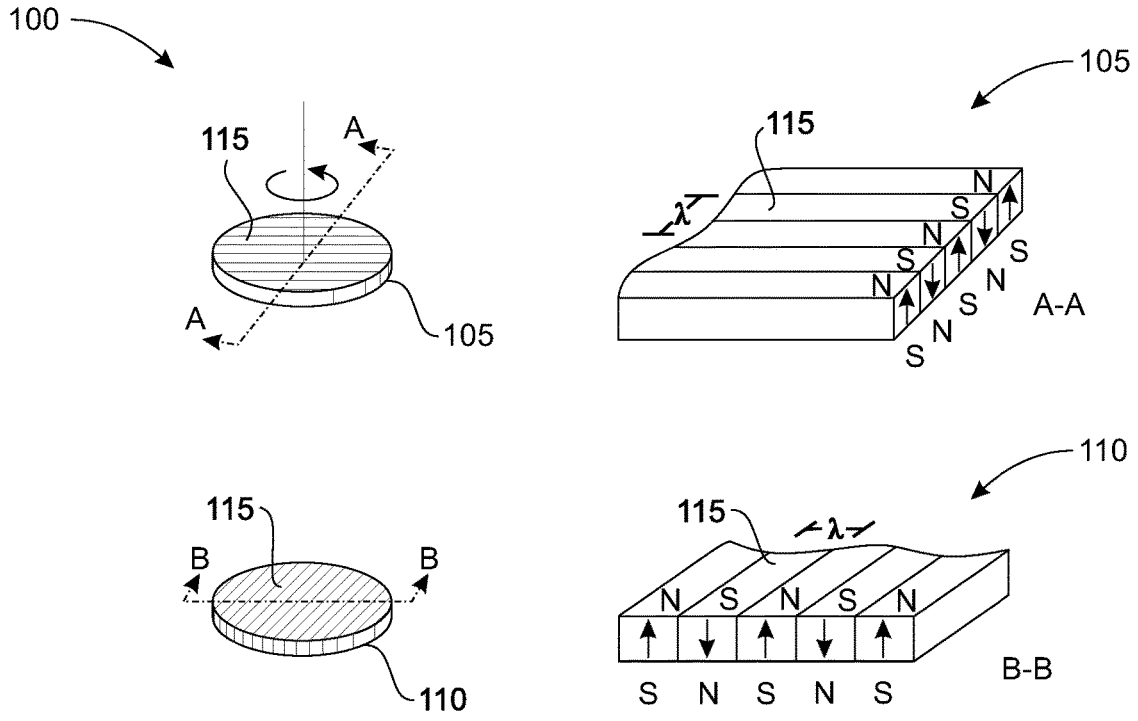
Figure 2:
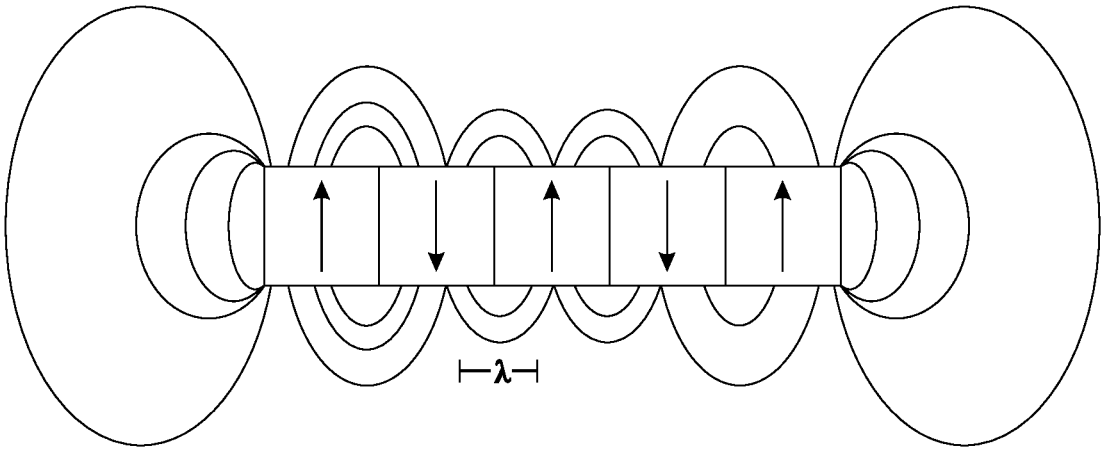
FIG. 2 depicts the magnetic field flux distribution of the exemplary magnets of FIG. 1A and FIG. 1B.

Referring to FIGS. 1A and 1B, a novel magnetic fastener 100 is proposed that utilizes a pair of multipole magnets 105, 110 rotatable relative to each other, allowing the holding force to be selected for ease of operation, namely closing and opening. Each multipole magnet 105,110 includes a striped pattern 115 of alternating north and south poles having about the same pole spacing or pitch. Shown in FIG. 2 is the associated magnetic flux distribution of the alternating polarity of each multipole magnet 105,110.

The present invention is based on the realization that when striped patterns of alternating polarity with about the same pitch, A, are mutually oriented lengthwise—along the Z-axis as depicted in FIG. 1A, the stripes of the south poles can judiciously align with the stripes of the north poles from the other multipole magnet, and vice-a-versa, creating a strong magnetic force between them to form a fastener. This latter configuration is the "latch" state of the magnetic fastener. However, when the striped pattern of alternating north and south poles are oriented substantially orthogonal, as depicted in FIG. 1B, the stripes are mutually being alternating attracted and repelled, substantially reducing, if not cancelling the magnetic force between them, and thereby allowing the magnets to be easily separated to effect opening. This is the "unlatched" configuration. As such, the present invention uniquely recognizes that selectively positioning multipole magnets having stripes of alternating polarity between two orientations, one lengthwise and the other orthogonal, may be used to produce a novel fastening device with a wide range of applications.

It should be understood that the striped pattern of alternating north and south poles may have a Halbach array configuration, wherein the alternating polarity has a spatially rotating pattern such that the magnetic field on one side is "strong" and "weak" on the opposing side. A Halbach array employs a special arrangement so that the magnetic field on one side of the array is augmented while on the opposing side the field is near zero. A simple example of a Halbach array is a so-called "refrigerator" magnet. Advantageously, by having the weak magnetic flux distribution of the magnets face externally, electronics outside the fasteners are magnetically shielded. To better understand this aspect of the present invention, it would be beneficial to examine briefly how a Halbach array works.

Figure 3:
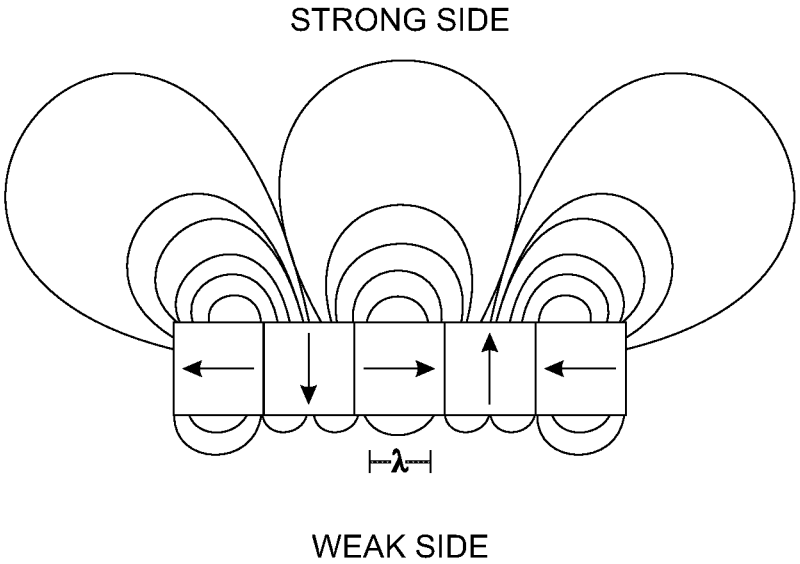
FIG. 3 depicts the magnetic field flux distribution of an exemplary magnet in a Halbach array.
Figure 4:
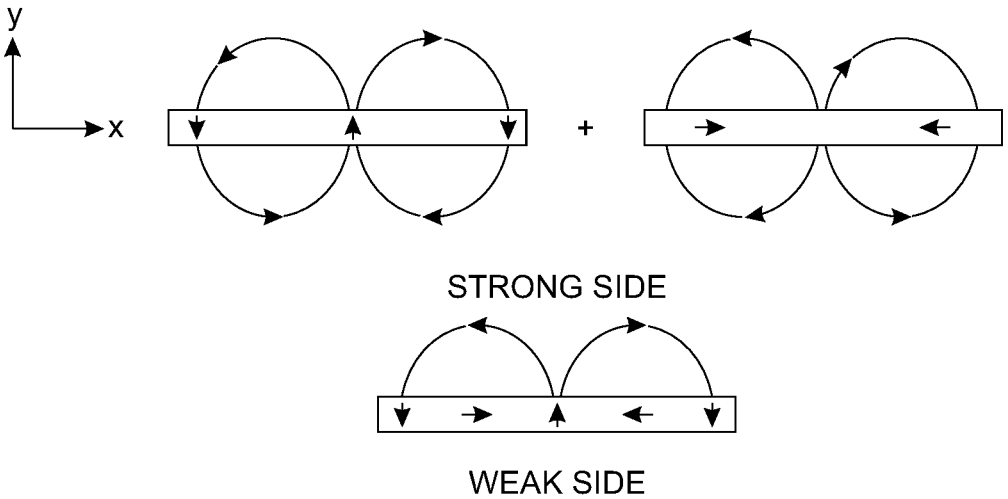
FIG. 4 is the superposition representation of the magnetic field flux distribution of a Halbach array.

A Halbach array employs a spatially rotating pattern of magnetism as depicted in FIG. 3, showing the magnetic flux distribution thereof. The arrows point from the south to the north pole. In contrast to a block magnet, the Halbach array has a very strong magnetic field on one side—the strong side—and a fairly weak field—the weak side—on the bottom. The stripes of alternating north and south poles are permanently magnetized with alternating magnetizations, but the alternating components of magnetizations are about 90 degrees out of phase. As depicted in FIG. 4, the flux distribution may be examined as the superposition of alternating magnetization in the y-direction, and alternating magnetization in x-direction. It should be understood that in this superposition, the magnetic fields above the magnet (positive Y direction) are in the same direction, producing a strong field. Importantly, the fields below the magnet (negative Y-direction) are in opposite directions, substantially cancelling out the fields to create a weak side. That is, the magnetic flux reinforces above the magnet and cancels out below.

It is to be understood that the figures and description below have been simplified to illustrate elements that are relevant for a clear understanding of the present invention, while eliminating, for purposes of clarity, other elements. However, because such elements do not facilitate a better understanding of the present invention, a discussion of such elements is not provided herein. However, the disclosure herein is directed to all such variations and modifications known to those skilled in the art.

Figure 5:
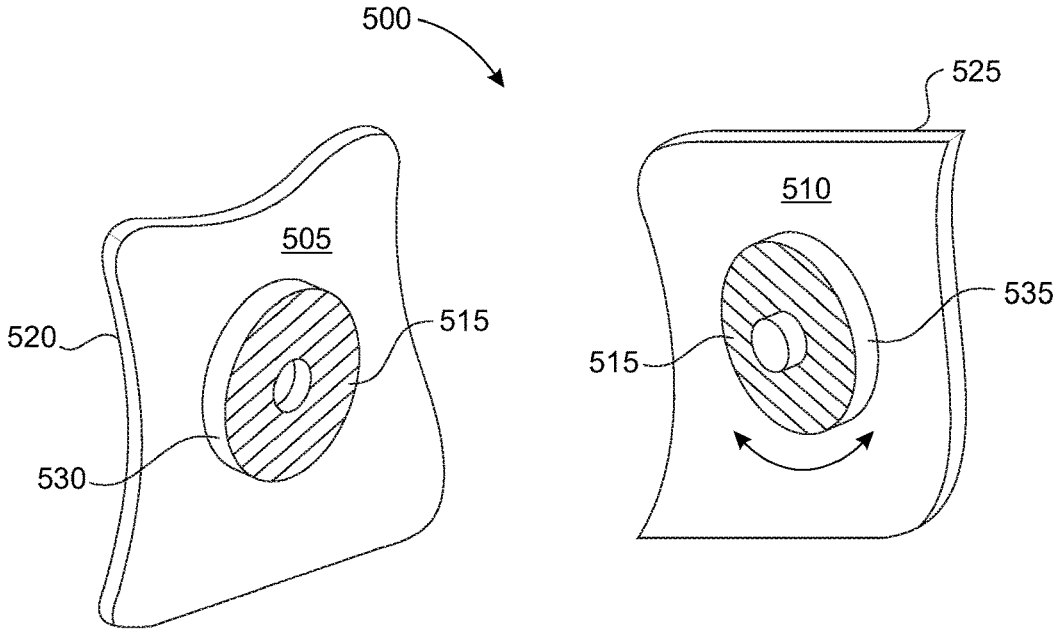
FIG. 5 is an embodiment of the magnetic fastener of the present invention.
Figure 6:
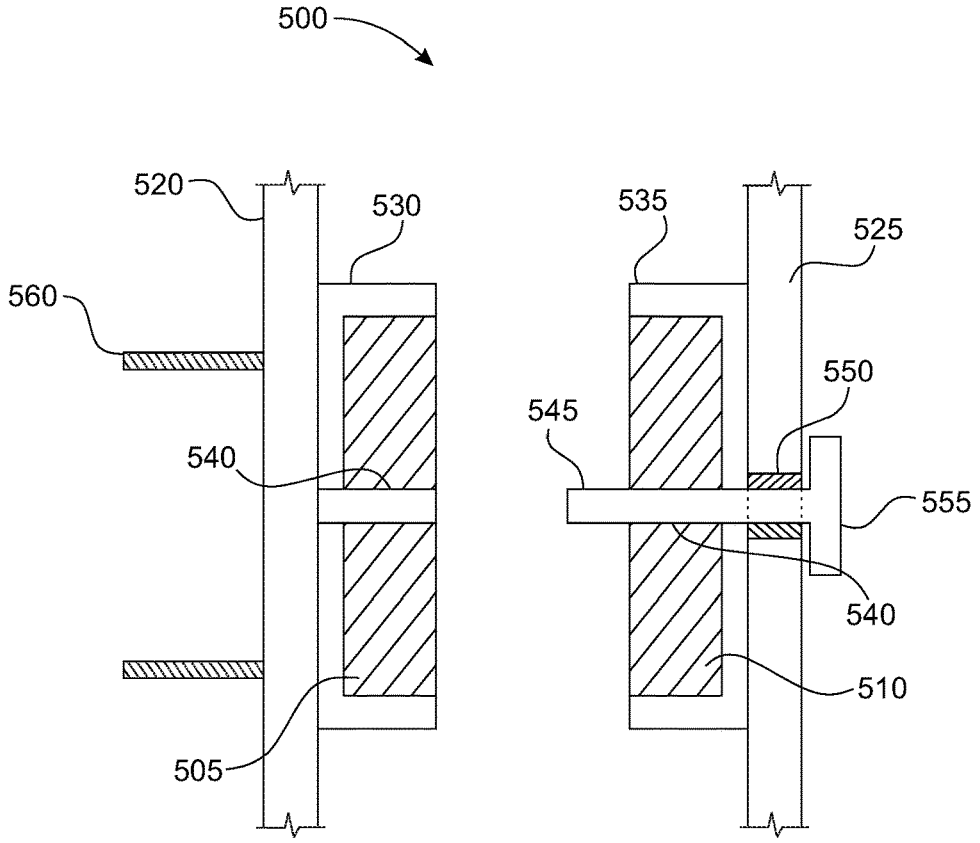
FIG. 6 is a cross-section of the magnetic fastener of FIG. 5.

As depicted in FIGS. 5-6, a novel magnetic fastener 500 is realized using multipole magnets 505,510, each that includes striped pattern 515 of alternating polarity having about the same pole spacing or pitch, A. The alternating poles may be configured in a Halbach array. Multipole magnets 505, 510 are placed on upper material 520 and lower material 525, respectively, configured to magnetically couple to each other when brought into close proximity. Of course, magnetic fastener 500 is used for fastening upper and lower material 520, 525 together. Materials 520,525 may include any substantially flat or planar material, such as leather, fabric, plastic or wood. In a Halbach array, multipole magnets 505, 510 are oriented so that the "strong side" of magnetic flux distribution face toward each other so as to shield components external thereto. Multipole magnets 505, 510 are each disposed within and preferably glued within recessed regions of housings 530, 535 to prevent the magnets from displacing laterally or vertically. Magnet 510, however, is not rigidly positioned with respect to material 525, but is free to rotate. That is, multipole magnets 505, 510 are configured to rotate relative to each other, allowing the holding force to be selected for ease of operation, namely closing ("latch") and opening ("unlatch"), as discussed above.

Multipole magnets 505,510 may be made of ferromagnetic material such as Neodymium, and disk in shape, each with a central hole 540. Tubular pin 545 is disposed through collar 550 into central hole 540, allowing multipole magnet 510 to rotate within a collar 550 relative to the other multipole magnet 505. For materials made of fabric, collar 550 may be unnecessary if tubular pin 545 rotates freely without binding in the material. Applying a torque on a handle or knob 555 that is connected to tubular pin 545 rotates multipole magnet 510, while still being held to material 525. Alternatively, handle or knob 555 may include a slot disposed within its head to receive a tool for rotating housing 535, and thereby also rotating multipole magnet 510. Such a slot may be configured as either a Phillips, Hex, Roberston, or Torx. Tubular pin 545 as well as handle 555 can be stamped or formed from metal so as to be integrally formed with housing 535, further confining the magnetic flux.

In operation, handle or knob 555 may be configured so as to effect a strong latch by turning the knob such that the striped patterns of alternating polarity of multipole magnets 505,510 are mutually oriented lengthwise. With about the same pole spacing or pitch, λ, the stripes of the south poles can judiciously align with the stripes of the north poles from the magnet (and vice-a-versa), thereby creating a strong magnetic force and fastening materials 520, 525 together. This is their so-called "latch" or "close" position. In rotating multipole magnets 510, a tactile feedback is noticed as the stripes of magnets 505, 510 align their poles—north to south and south to north. Attempting to unfasten multipole magnets 505, 510 in the "latch" position requires a force of more magnitude.

Although multipole magnets 505, 510 will somewhat slide along the lengthwise directions of the poles, it is much more difficult to do so in the orthogonal direction while in the "latch" position. Forcing them to slide across one another in the "latch" position produces a chattering sound. To unlatch, handle 555 must be rotated about 90 degrees such that the striped patterns of alternating polarity in multipole magnets 505, 510 are oriented orthogonal. In the "unlatch" or "open" position, the stripes are being alternating attracted and repelled, substantially reducing, if not cancelling the magnetic force between them. As such, the fastener is more easily pulled apart. Multipole magnets 505,510 also side more easily across each other in either directions in the "unlatch" position. In operation, selectively positioning magnets 505, 510 between the two orientations, one lengthwise and the other orthogonal, is used to fasten and unfasten materials 520, 525, respectively.

A marker positioned on handle 555 may be used to indicate the "latch" and "unlatch" configurations. Again, the magnitude of the magnetic attraction between the multipole magnets is relatively weak in the "unlatch" or "open" position and substantially stronger in the "latch" or "close" position. Such an indicator is particularly advantageous for commercial applications which may require larger dimension fasteners where it is important to visually know that the fastener is in the "latch" position.

It may be preferable to use the stripes of alternating poles in a Halbach array to shield any external electronics. Also, legs 560 may be used to attach magnet 505 to material 520, or can be affixed thereto by glue, screw, or even Velcro®, among other means. Various shapes may be used, and magnets 505, 510 need not be circular.

Figure 7:
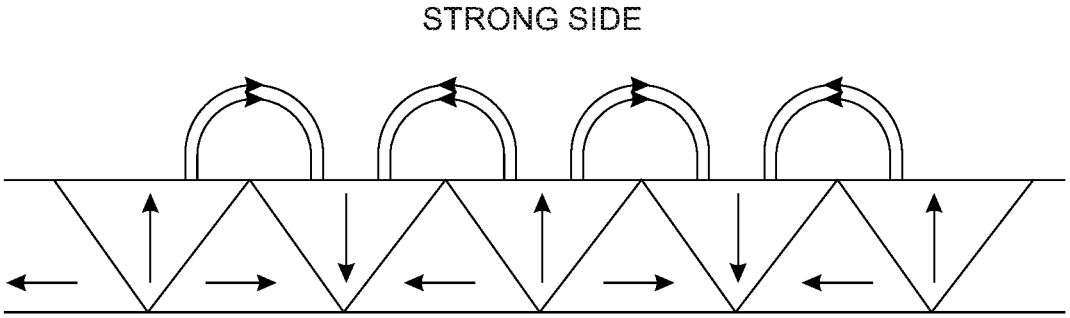
FIG. 7 is a cross section of a typical "refrigerator" magnet employing a Halbach array and the magnetic field flux distribution thereof.

Multipole magnets 505, 510 can be fabricated from a flexible Neodymium magnet sheet having stripes of poles that alternate between north and south with about the same pole spacing or pitch, λ. For example, micro-crystalline NdFeB ground powder may be mixed in a polymer matrix. When passed through strong cylindrical magnets or a rotating field, the striped pattern of alternating polarity is formed in the magnet sheet. Of course, the stripes of alternating polarity can use a Halbach array, commonly used in "refrigerator" magnets, as shown in FIG. 7. Ferrite powder can also be used, but is not as strong Neodymium which exhibits about four to ten times greater pull force than a ferrite powder. Also Neodymium magnets sheets are not as easily susceptible as ferrite magnet sheets to demagnetization when in proximity or in contact with other strong magnets. Multipole magnets 505, 510 can also be manufactured from permanent solid magnets, but at a greater cost.

To gain a better understanding of the present invention, it is noteworthy to examine how the characteristics of the striped patterns affect the magnetic pull force. The magnetic pull force is related to the surface area as well as the thickness of the multipole magnets, and accordingly can be judiciously chosen for its intended purpose and application. The holding force that results from the interaction of the alternating poles is proportional to the total length of the stripes formed by the poles. Closely spaced poles typically have a greater holding force since there are more stripes per inch. In a design for a particular application, it should be understood that while the closer pole spacing produces a strong holding force, more widely spaced poles have a greater throw, and hence attract more strongly from a distance. That is, the magnetic field is stronger at larger distances, and is a design choice for the desired application. Flexible Neodymium magnet sheets are available in various thicknesses, up to about 3 mm, with pole spacing or pitch, λ, ranging from one to several millimeters apart, and sometimes referred to as poles per inch (PPI). Various shapes can be custom fabricated, including circular disks, or washers.

Figure 8:
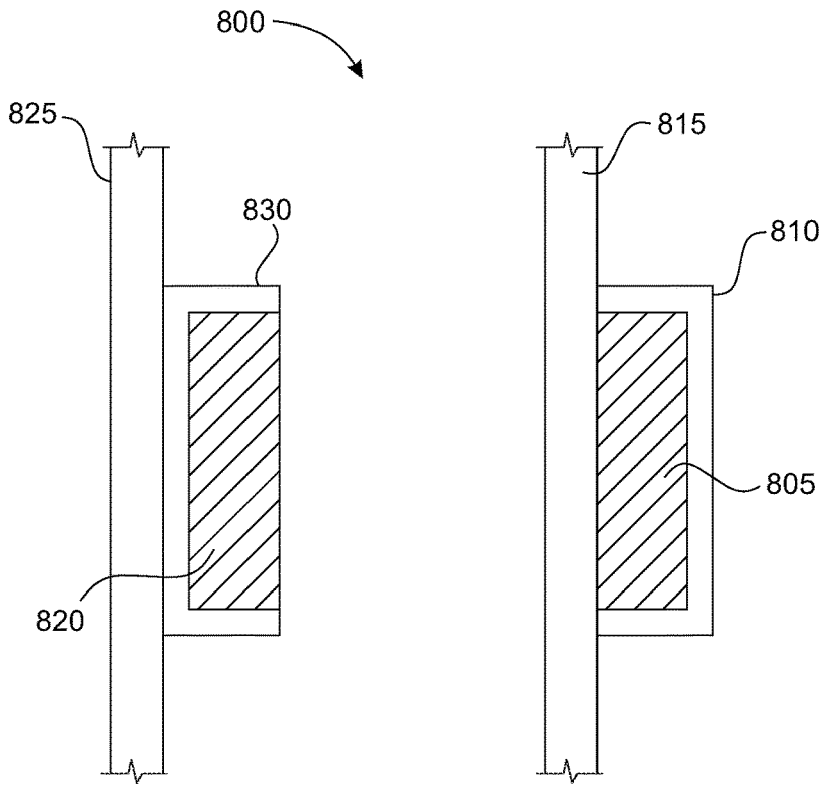
FIG. 8 is a cross section of another embodiment of the magnetic fastener of the present invention.

FIG. 8 depicts a magnetic fastener 800 in accordance with another embodiment of the present invention. A multipole magnet 805 having a striped pattern of alternating polarity as discussed above herein is disposed within a recessed region of cap housing 810. Multipole magnet 805 attaches a piece of material 815 to another multipole magnet 820 that is in turn affixed to material 825. Similarly, multipole magnet 820 is disposed within a recessed region of a cylindrical housing 830. Rotating housing 810 mutually aligns lengthwise the stripes of multipole magnets 805, 820, creating a strong magnetic force between them that results in the attachment of the two pieces of material 815, 825. Rotating housing 810 about 90° orients the striped patterns of multipole magnets 805, 820 substantially orthogonal, making it easy to pull cap housing 810 away from housing 830, and unfastening material 815 from material 825. Similarly, multipole magnets 805,820 may utilize a Halbach array. Neither housings 810,830, nor multipole magnets 805, 820, however, need to be circular. Rectangular shapes housings and magnets may be employed, and could be advantageous in indicating when the multipole magnets are in their "latch" and "unlatch" positions due to its asymmetry. The periphery of cap housing 810 may be fabricated with a series of grooves or indents to make it easier to rotate the housing.

Figure 9:
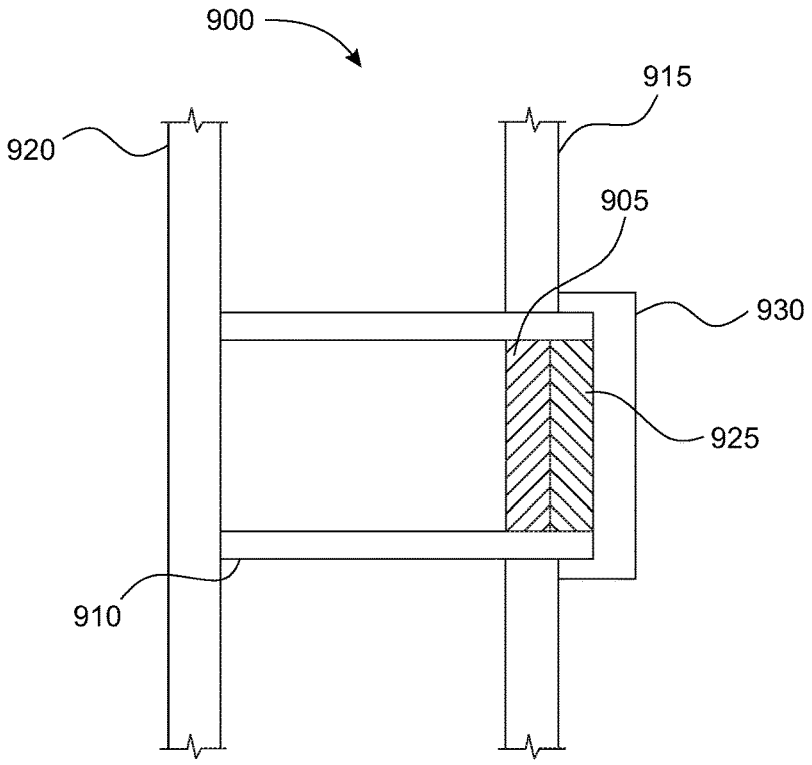
FIG. 9 is a cross section of still another embodiment of the magnetic fastener of the present invention.

In another embodiment of a magnetic fastener 900, shown in FIG. 9, a multipole magnet 905 is disposed within a recessed region of cylindrical housing 910 that extends partially through a suitably sized opening in material 915, such as wood or glass. Housing 910 is screwed or glued to a material 920, such as sheetrock, plastic or wood. Another multipole magnet 925 of about the same dimensions as multipole magnet 905 is similarly disposed within a cap housing 930 for receiving a portion of cylindrical housing 910 extending beyond material 915 so that housing 910 is securely held in place by cap housing 930. In a "latch" or "close" position, the stripes of alternating south and north poles of multipole magnets 905 align lengthwise with the alternating poles of multipole magnet 925, creating a strong magnetic force when they are brought into close proximity. Rotating cap housing 930 so that the striped patterns of alternating poles of multipole magnets 905, 925 are orthogonal weakens the magnetic force and places fastener 900 in its "unlatch" or "open" position, allowing cap housing 930 to be easily pulled apart from housing 910. In this latter configuration, material 915 can be pulled away from and removed from housing 910, thereby unfastening material 915 from material 920. Likewise, grooves or indents may be fabricated around the periphery of cap housing 930 to better facilitate rotating the cap.

It should be understood that the embodiments herein are merely illustrative of the principles of the invention. Various modifications may be made by those skilled in the art which will embody the principles of the invention and fall within the spirit and scope thereof.

What is claimed is:

1. A magnetic fastener comprising: first and second unitary, single multipole magnets with opposing surfaces, each magnet having a striped pattern of long, parallel, narrow bands of alternating north and south poles, each pole running in a lengthwise direction along entire said opposing surfaces, with the north and south poles alternating in a widthwise direction, said first unitary, single multipole magnet attachable to a first material, and said second unitary, single multipole magnet rotatably attachable to a second material, wherein mutually orienting the striped pattern of alternating north and south poles of said first and second unitary, single multipole magnets along the lengthwise direction places said magnetic fastener in a latch configuration, whereby a strong magnetic force between said first and second single, unitary multipole magnets provides magnetic fastening between said first and second materials, and wherein rotating said second unitary, single multipole magnet with respect to said first single, unitary multipole magnet, such that the striped patterns of alternating north and south poles of said first and second single, unitary multipole magnets are oriented orthogonal such that the lengthwise direction of one of said multipole magnets runs along the widthwise direction of the other multipole magnet, thereby placing said magnetic fastener in an unlatch configuration, substantially reducing the magnetic force between said first and second unitary, single, multipole magnets, allowing said first and second materials to be easily separated.

2. The magnetic fastener of claim 1, wherein the striped patterns of alternating north and south poles of said first and second single, unitary multipole magnets are in a Halbach array.

3. The magnetic fastener of claim 1, wherein the striped patterns of alternating north and south poles of said first and second single, unitary multipole, magnets have about the same pole spacing or pitch, $\lambda$.

4. The magnetic fastener of claim 1 wherein said first and second single, unitary multipole magnets are disk in shape, each with a center hole aligned axially with said first and second single, multipole magnets.

5. The magnetic fastener of claim 1 wherein said first and second single, unitary multipole magnets are made from a flexible Neodymium magnet sheet.

6. The magnetic fastener of claim 1 further comprising a tubular pin extending through the center hole of said second single, multipole magnet with a portion extending therethrough, wherein in said latch configuration, the magnetic force between said first and second single, unitary multipole magnets forces said tubular pin into the center hole of said second single, unitary multipole magnet.

7. The magnetic fastener of claim 1 further comprising first and second housings, each having a recessed region, said first and second single, unitary multipole magnets disposed within the recessed regions of said first and second housings, respectively.

8. The magnetic fastener of claim 1 further comprising a knob attached to an end of said second housing for rotating said second single, unitary multipole magnet with respect to said first single, unitary multipole magnet, so as to place said magnetic fastener into the latch or unlatch configuration of said magnetic fastener.

* * * * *